US011123630B2

(12) United States Patent
Spremberg et al.

(10) Patent No.: US 11,123,630 B2
(45) Date of Patent: Sep. 21, 2021

(54) PLAYING FIELD BORDERS FOR A SMALL PLAYING FIELD

(71) Applicant: SoccerGround GmbH & Co. KG, Hennef (DE)

(72) Inventors: Gerhard Spremberg, Hennef (DE); Natalie Rekittke, Berlin (DE)

(73) Assignee: SoccerGround GmbH & Co. KG, Hennef (DE)

( * ) Notice: Subject to any disclaimer, the term of this patent is extended or adjusted under 35 U.S.C. 154(b) by 0 days.

(21) Appl. No.: 17/026,384

(22) Filed: Sep. 21, 2020

(65) Prior Publication Data

US 2021/0086060 A1 Mar. 25, 2021

(30) Foreign Application Priority Data

Sep. 20, 2019 (DE) ..... 102019125318.7

(51) Int. Cl.
*A63C 19/08* (2006.01)
*E04H 17/16* (2006.01)

(52) U.S. Cl.
CPC ..... *A63C 19/08* (2013.01); *E04H 17/16* (2013.01); *A63C 2019/085* (2013.01)

(58) Field of Classification Search
CPC ..... E01C 3/006; A63C 19/00; A63C 19/08; A63C 2019/085
USPC ..... 472/92, 94; 52/272, 273
See application file for complete search history.

(56) References Cited

U.S. PATENT DOCUMENTS 3,883,120 A * 5/1975 Tippmann ..... E04H 17/16 256/24
6,004,217 A * 12/1999 Johnston ..... A63C 19/06 256/24
6,517,442 B1 * 2/2003 Post ..... A63C 19/10 256/25
2003/0079427 A1 * 5/2003 Mackay ..... E04B 1/2604 52/261
2006/0074687 A1 * 4/2006 Bickel ..... G06F 3/0481 704/275

FOREIGN PATENT DOCUMENTS

DE 102009005533 A1 7/2010

* cited by examiner

*Primary Examiner* — Kien T Nguyen
(74) *Attorney, Agent, or Firm* — Michael Soderman

(57) ABSTRACT

A playing field boundary for a small playing field, which is modularly constructed of fence elements (16) in the form of plates or panels and vertical posts, to which these fence elements (16) are attached. The individual panels of the fence elements are bordered at least on the top by approximately horizontally running handrail profiles (17), wherein butt connectors (18) are respectively provided, which each overarch two adjacent handrail profiles (17) across a part of their length at the region where they meet. The butt connectors (18) each connect two adjacent fence elements (16) among one another, wherein fastening devices extending in the transverse direction to the handrail profiles (17) are provided in order to connect one butt connector (18) each to two adjacent handrail profiles (17) respectively. and wherein shearing/pressure elements are provided in the region of the butt connectors.

10 Claims, 11 Drawing Sheets

PLAYING FIELD BORDERS FOR A SMALL PLAYING FIELD

CROSS REFERENCE TO RELATED APPLICATIONS

This application claims the priority of DE 102019125318.7 filed on 2019 Sep. 20; this application is incorporated by reference herein in its entirety.

BACKGROUND

The present invention relates to a playing field boundary for a small playing field, which is modularly constructed of fence elements in the form of plates or panels and vertical posts, to which these fence elements are attached, wherein the individual panels of the fence elements are bordered at least on the top by approximately horizontally running handrail profiles, wherein butt connectors are respectively provided, which each overarch two adjacent handrail profiles across a part of their length at the region where they meet, wherein the butt connectors each connect two adjacent fence elements to each other, wherein fastening devices extending in the transverse direction to the handrail profiles are provided in order to connect one butt connector each to two adjacent handrail profiles, and wherein shearing/pressure elements are provided in the region of the butt connectors to respectively connect adjacent handrail profiles to one another in their longitudinal direction in a high-tensile-strength and pressure-resistant manner.

A playing field boundary for a small playing field with the features of the above-mentioned type has become known from DE 10 2009 005 533 A1 for example. In this known solution, stop elements are provided on the inner side on the handrail profiles to be connected, which serve as thrust bearings for plate elements, which can be pushed into the handrail profiles, wherein, via the plate elements and the stop elements, the adjacent handrail profiles can be connected to one another in a high-tensile-strength and pressure-resistant manner by means of a screw connection. Alternatively to this, the fastening device for the connection of two adjacent fence elements can comprise cam elements, which serve as thrust bearings for cam elements inside the butt connector, wherein the adjacent handrail profiles can be connected to one another in a high-tensile-strength and pressure-resistant manner by means of a screw connection in the transverse direction. The cam elements comprise surfaces that are rectangular to one another and cam surfaces that are firmly fixed inside the butt connectors are assigned to these cam elements and align with this in the mounted position of the butt connectors.

SUMMARY

The invention relates to a playing field boundary for a small playing field, which is modularly constructed of fence elements (16) in the form of plates or panels and vertical posts, to which these fence elements (16) are attached, wherein the individual panels of the fence elements are bordered at least on the top by approximately horizontally running handrail profiles (17), wherein butt connectors (18) are respectively provided, which each overarch two adjacent handrail profiles (17) across a part of their length at the region where they meet, wherein the butt connectors (18) each connect two adjacent fence elements (16) among one another, wherein fastening devices extending in the transverse direction to the handrail profiles (17) are provided in order to connect one butt connector (18) each to two adjacent handrail profiles (17) respectively, and wherein shearing/pressure elements are provided in the region of the butt connectors to respectively also connect adjacent handrail profiles to one another in their longitudinal direction in a high-tensile-strength and pressure-resistant manner, wherein, according to the invention, pins or bolts integrated into the butt connectors are provided as shearing/pressure elements, which each engage into corresponding bore holes of two adjacent handrail profiles (17).

DETAILED DESCRIPTION

The object of the present invention is to create a playing field boundary for a small playing field of the above type, in which an alternative, constructionally simple and effective solution is provided for the transmission of shear forces in the longitudinal direction of the handrail profiles, as well as for the absorption of tensile and compressive forces, which act on the playing field boundary in the transverse direction.

The solution to this task provides a playing field boundary for a small playing field of the aforementioned genre with the characteristic features of the main claim.

According to the invention, it is provided that pins or bolts integrated into the butt connectors are provided as shearing/pressure elements, which each engage into corresponding bore holes of the two adjacent handrail profiles. The pins or bolts create a shear-resistant connection between the handrail profiles and the butt connectors in the longitudinal direction of the handrail. For example, one, two, three, or four or a plurality of pins or bolts can be provided on each butt connector. If the butt connector comprises at least two pins or bolts, one pin or bolt can engage into each of the two adjacent handrail profiles to be connected. For example, in the case of four pins or bolts on a butt connector, two pins or bolts can each engage into two bore holes of each of the two adjacent handrail profiles.

The small playing fields according to the invention have a rectangular ground layout with two longitudinal sides and two transverse sides. The playing field boundary according to the invention usually comprises corner posts, which optionally have a larger vertical extension than the panels in the corner regions, i.e. where the longitudinal sides each meet the transverse sides. Intermediate posts are arranged between the corner posts at least on the longitudinal sides at distances to each other. Particularly on the longitudinal sides of the playing field boundary, considerable shear forces occur that act on the playing field boundary since the spectators push against this. The aforementioned pins or bolts in the butt connectors, which engage into the bore holes of the handrail profiles of two adjacent fence elements, absorb the shear and tensile forces acting in the longitudinal direction of the playing field boundary.

Preferably, the pins or bolts are each welded into the butt connectors, thereby being connected to these in a substance-to-substance manner.

In accordance with a preferred further embodiment of the present invention, the butt connectors are designed as downwardly open U-profiles and the pins or bolts are each attached on the inner side and, in the mounted state, attached to an upper horizontal bar of these U-profiles protruding downwards.

According to the invention, it is preferred that the handrail profiles are designed as rectangular profiles and the bore holes that receive the bolts or pins of the butt connectors are incorporated into the upper horizontal wall of the rectangular profiles.

In accordance with a preferred further embodiment of the invention, to connect the vertical posts of the playing field boundary to the handrail, the vertical posts are extended upwardly into the butt connectors and the posts each comprise a head plate with at least one bore hole, wherein the butt connectors comprise at least one corresponding bore hole for a fastening screw, which is used to connect the butt connectors to the posts in the vertical direction. By means of this, the butt connectors, which preferably have a U-shaped cross section and are open towards the bottom and are also rounded off at the top, are secured against being removed or falling from the handrail. Via these screw connections, the vertical forces are therefore also introduced into the posts by the butt connectors overarching the handrail profiles.

In accordance with a preferred further embodiment of the invention, in addition to the handrail profiles in the lower regions of the panels, footpath profiles are provided, which extend in the longitudinal direction of the playing field boundary, wherein, in the connecting region of two adjacent fence elements, butt connectors, which are open towards the top and have a U-shaped cross-sectional profile, are provided for the footpath profiles, wherein pins or bolts, which engage into corresponding bore holes of the footpath profiles, are also integrated into these butt connectors, which are used as shearing/pressure elements in the footpath region. The handrails, which preferably have a U-shaped profile, as well as the corresponding footpath profiles border the preferably sound-dampened sandwich panels, thereby forming a largely stiff playing field wall. The said footpath profiles, which extend within the lower region of the playing field boundary are suitable, due to the pins or bolts that are also present here, for reliably introducing, in a static manner, shearing/pressure forces acting on the ground level into the footpath profiles, thereby transmitting these forces onto the corner posts of the playing field.

For example, a U-shaped socket can be welded onto the bottom of the vertical posts as a butt connector, which is provided with thrust-pressure pins on both sides of the post.

The footpath profiles are provided with corresponding bore holes and are inserted into this U-shaped socket in a non-positive locking manner.

A possible constructional variant of the invention provides that at least some of the vertical posts are designed as intermediate posts, which comprise, in the region of the butt connectors, two a vertically running metal sheets orientated in the longitudinal direction of the playing field boundary and a vertically orientated U-profile, which is arranged between these metal sheets and connected to these metal sheets, wherein only the two metal sheets extend downwards in the vertical direction to the butt connectors.

The vertical intermediate posts may comprise a reinforced construction of the aforementioned type, wherein the intermediate posts may be reinforced by a vertically running additional rectangular post profile arranged next to the two metal sheets and the U-profile.

In a preferred constructional design variant of the invention, it is such that, at a distance to inner handrail profiles, parallel outer handrail profiles are furthermore arranged, which are also connected to each other via butt connectors in the longitudinal direction, wherein profile-like connectors running at a right angle to the inner and outer handrail profiles connect the butt connectors to one another for the inner handrail profiles and for those for the outer handrail profiles, wherein the butt connectors for the outer handrail profiles can preferably be connected to the outer handrail profiles via pins or bolts, which each engage into corresponding bore holes of the two adjacent handrail profiles, and/or via horizontal screw connections.

Due to the connectors running between the inner handrail profile and the outer handrail profile, a kind of Vierendeel system is created, wherein the connectors consist, for example, of a rectangular pipe and can be welded into the preferably U-shaped handrail profiles in a rigid manner. The connectors are used to receive the vertical forces acting on the outer handrail, for example, due to leaning or even sitting spectators, wherein, preferably, a reinforcement blade protruding outwardly from the vertical post at right angle is present, which has a standing surface at its underside.

The constructional variant with the additional parallel outer handrail is particularly suitable for creating a playing field boundary that remains stable over the long term, which can do without foundations firmly anchored in the ground. This makes it possible to save on construction work for laying foundations. In addition, there are many locations for the small playing fields, for example, in the area of a contaminated building site, where the removal of excavation masses is very expensive or technically impossible to achieve due to the pollution of the soil, for example, when sealing protective film systems are present in the soil, which secure former landfills and thus do not allow for deeper foundations.

The features mentioned in the subclaims relate to preferred further embodiments of the task solution according to the invention. Further advantages of the invention arise from the following detailed description.

In the following, the present invention is described in more detail based on the exemplary embodiments with reference to the enclosed drawings.

DETAILED DESCRIPTION OF THE PREFERRED EMBODIMENTS

Figure 1:
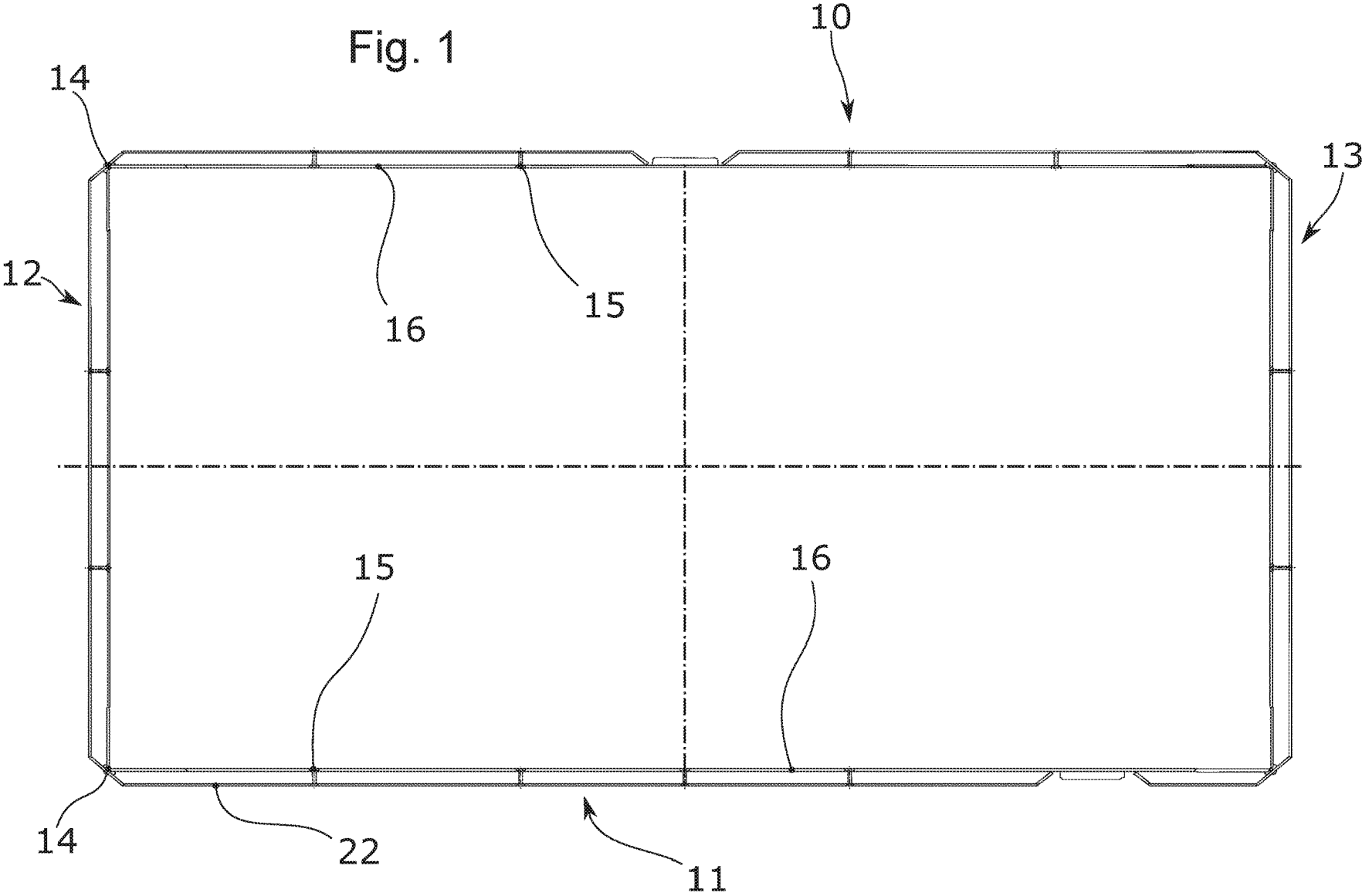
FIG. 1 a schematically simplified top view on a small playing field according to the invention.

Initially, reference is made to FIG. 1 and the basic structure of a small playing field according to the present invention is explained based on this. This has, for example, a roughly rectangular ground layout with two parallel longitudinal sides 10, 11, two parallel transverse sides 12, 13, which connect the two longitudinal sides to one another, and four corner posts 14, each in the corner regions, where each the longitudinal sides 10 and 11 meet the transverse sides 12, 13. The playing field boundary for the small playing field is modular and consists of interconnected fence elements 16 on the two longitudinal sides 10, 11 and on the two transverse sides 12, 13 in the form of plates or panels and vertical posts 15, to which these fence elements 16 are attached.

Figure 2:
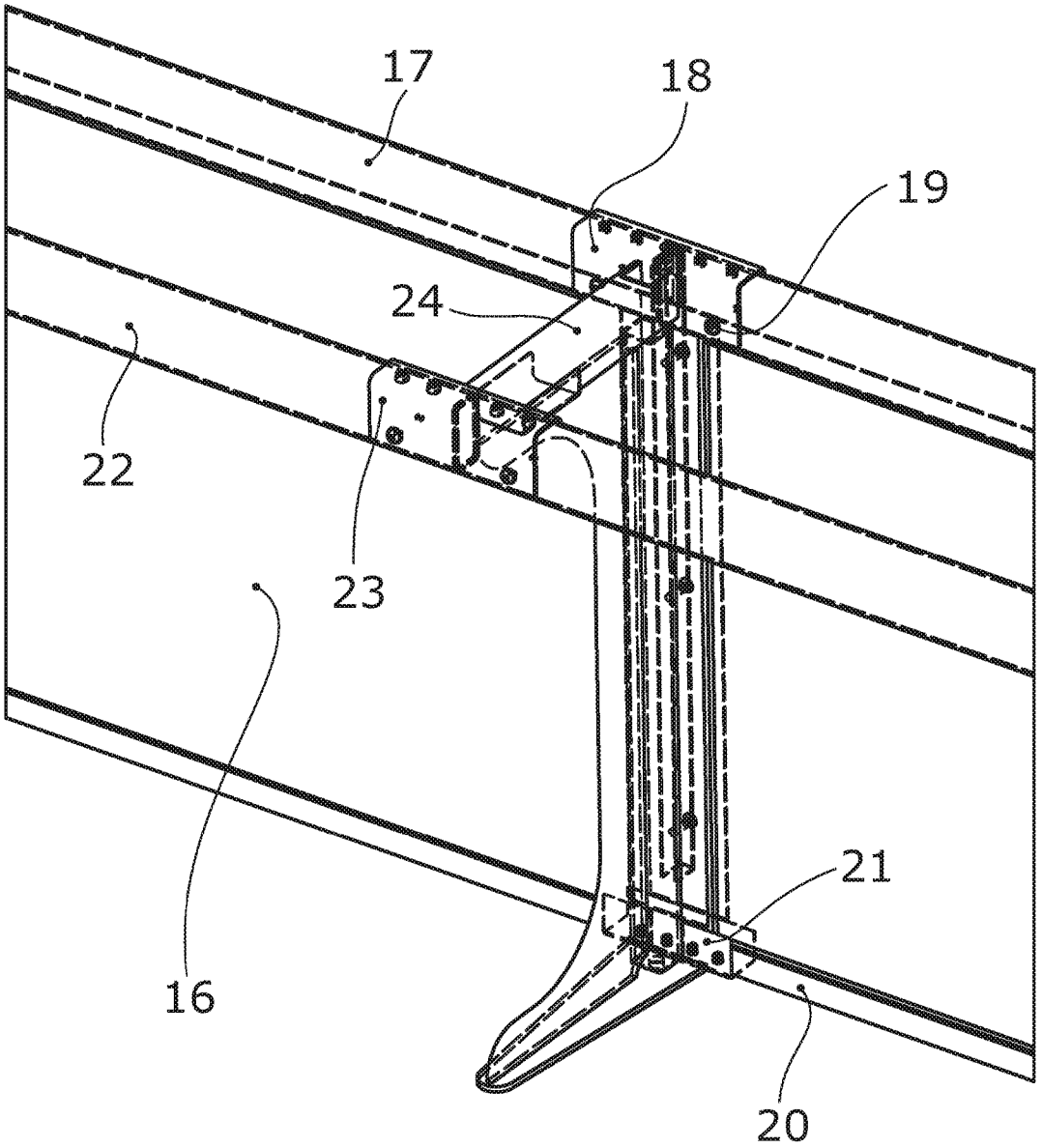
FIG. 2 a perspective view of a section of the playing field boundary.

As can be seen in FIG. 2, which shows a section, for example, of one of the longitudinal sides of the playing field boundary, the individual panels 16 of the fence elements are bordered on the top by approximately horizontally running handrail profiles 17, wherein butt connectors 18 are respectively provided, which each overarch two adjacent handrail profiles 17 across a part of their length at the region where they meet, wherein the butt connectors 18 each connect two adjacent fence elements 16 among one another and wherein fastening devices 19 extending in the transverse direction to the handrails are provided in order to connect one butt connector 18 each to two adjacent handrail profiles 17 respectively. It can be seen in FIG. 2 that, in addition to the handrail profiles 17 in the lower regions of the panels 16, footpath profiles 20 are provided, which extend in the longitudinal direction of the playing field boundary, wherein, in the connecting region of two adjacent fence elements 16, butt connectors 21, which are open towards the top and have a U-shaped cross-sectional profile, are provided for the footpath profiles 20, wherein these connectors 21 can also be connected to the footpath profiles 20 via fastening elements, which are still be explained further below.

Furthermore, it can be seen in FIG. 2 that, at distance to the inner handrail profiles 17, which are facing the playing field, in addition, parallel outer handrail profiles 22 are arranged, which are also connected to one another via butt connectors 23 in the longitudinal direction, wherein, profile-like connectors 24 running at right angle to the inner and the outer handrail profiles connect the butt connectors 18 for the inner and those 23 for the outer handrail profiles 22 to one another, wherein the butt connectors 23 for the outer handrail profiles 22 can preferably be connected to the outer handrail profiles via pins or bolts, which each engage into corresponding bore holes of the two adjacent handrail profiles 22, and/or via horizontal screw connections. The connectors 24 are used to receive the vertical forces acting on the outer handrail 22, for example, due to leaning or even sitting spectators, wherein, preferably, a reinforcement blade 26, which has a standing surface at its underside, is present that protrudes outwardly at a right angle starting from the vertical post 25 located where two adjacent panels 16 meet.

More detailed details concerning the vertical posts 15 and the outwardly protruding reinforcement blades 26 are derived from the illustration in accordance with FIG. 8, to which reference is made below. Some of the vertical posts 15, which lie on the longitudinal sides and optionally also on the transverse sides each between the corner posts 14, are designed as intermediate posts and comprise, on the one hand, a vertically orientated rectangular post profile 27 and, additionally, two metal sheets 28 running vertically and orientated in the region of the butt connectors in the longitudinal direction of the playing field boundary and a vertically orientated U-profile 29, which is arranged between these metal sheets 28 and connected to these metal sheets, wherein only the two metal sheets 28 extend downwards in the vertical direction to the lower butt connectors 21. The reinforcement blades 26 have a lower standing region 26 a, which can also be recognized in the horizontal section view A-A in accordance with FIG. 9, in which one also sees the structure of the post with post profile 27, metal sheets 28 and a U-profile 29. In addition, in FIG. 9, the lower upwardly open U-shaped butt connector 21 for the footpath profiles 20 can be recognized.

Figure 3:
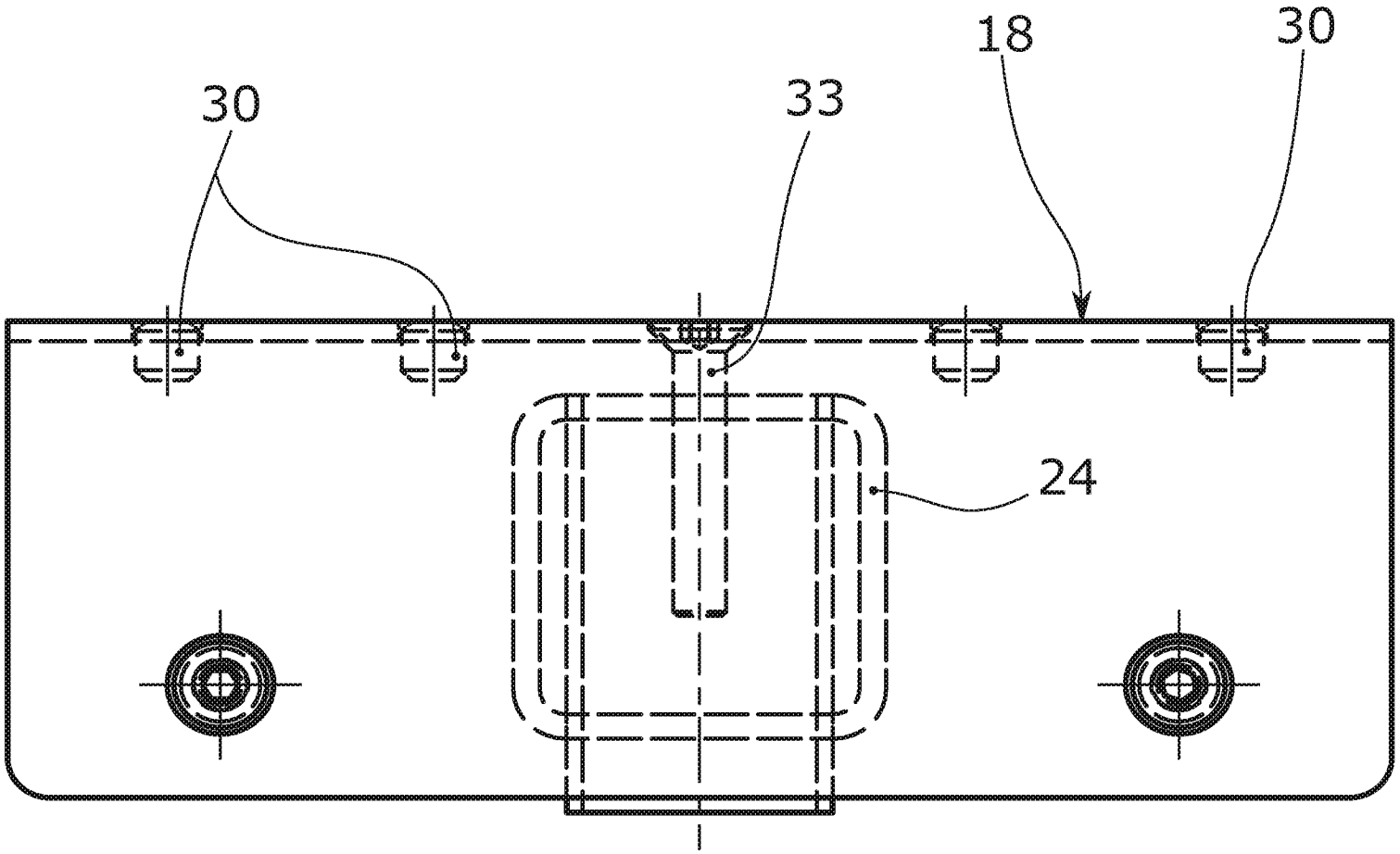
FIG. 3 a side view of a single butt connector.
Figure 4:
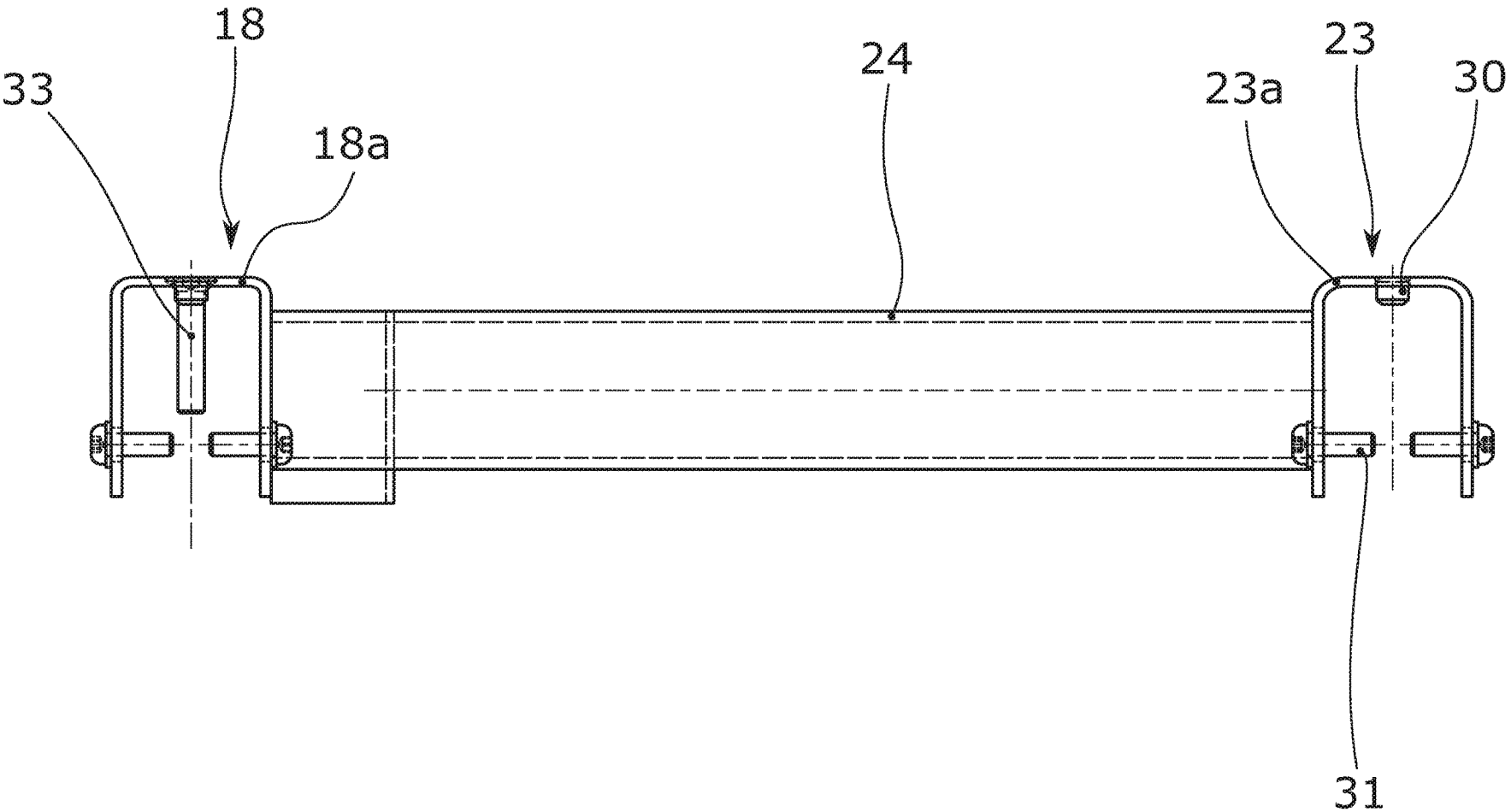
FIG. 4 a view of two parallel butt connectors in the direction of the arrow IV viewed from FIG. 5.
Figure 5:
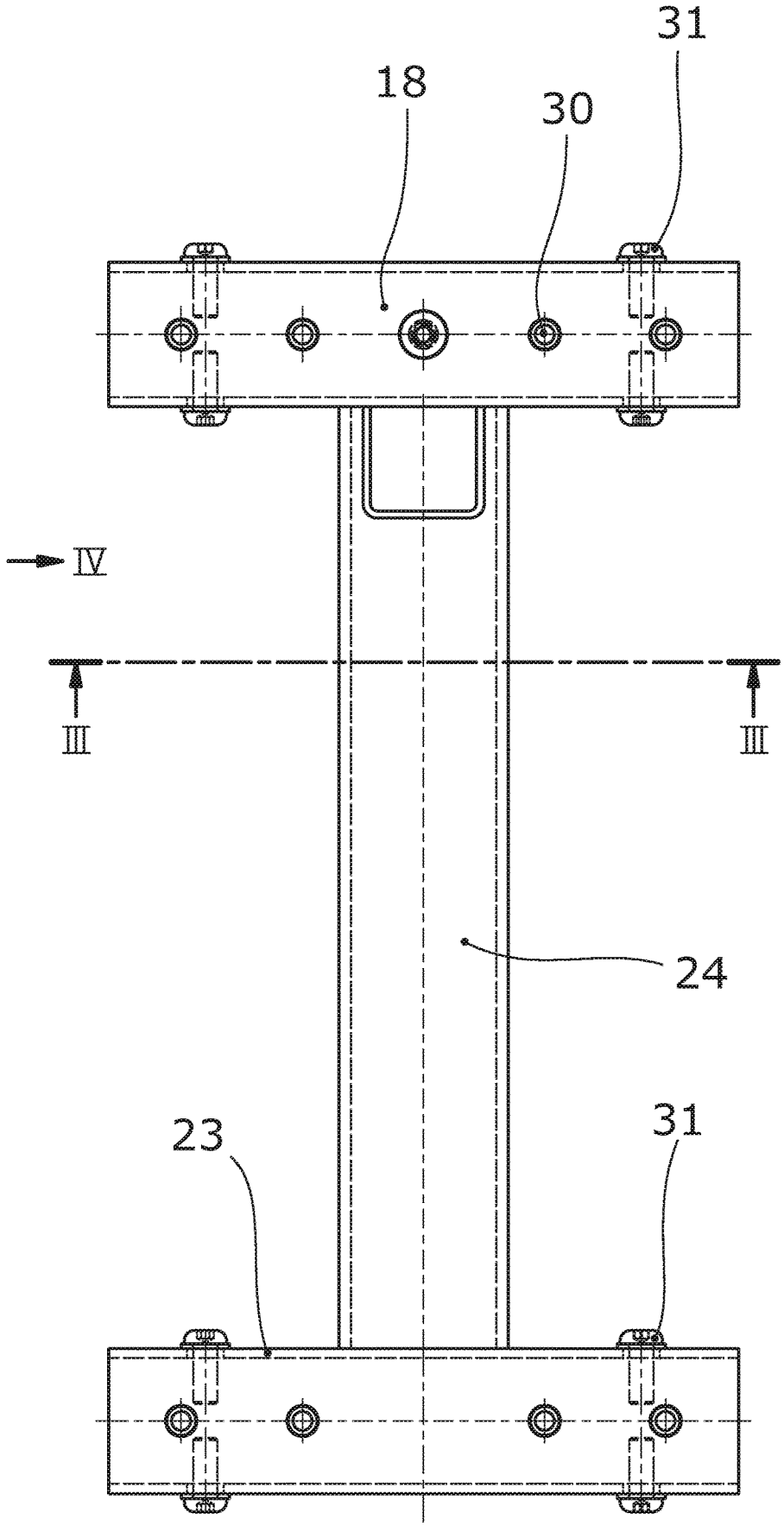
FIG. 5 a top view in the region of the butt connectors in FIG. 4.

In the following, reference is now made to the FIGS. 3 to 5. FIG. 3 shows a side view of one of the upper butt connectors 18 for the handrail profiles 17 at an enlarged scale. In FIG. 4 shows a unit with a butt connector 18 for the inner handrail profile 17, a butt connector 23 for the outer handrail profile 22, and a connector 24, which connects these two in the transverse direction to the longitudinal extension of the playing field boundary, the panels and handrails. In FIG. 5, a top view of this unit is shown. As is shown in FIG. 4, the butt connectors 18 are U-profiles that are open downwards. Pins 30 or bolts integrated in the butt connectors 18 are provided as shearing/pressure elements, which each engage into corresponding bore holes of the two adjacent handrail profiles. These pins 30 or bolts can be welded into the butt connectors and the pins 30 or bolts can each be attached on the inner side and, in the mounted state, attached to an upper horizontal bar 18 a/23 a of these U-profiles 18/23 protruding downwards. The bore holes that receive the bolts or pins 30 of the butt connectors 18/23 can be incorporated into the upper horizontal wall of the rectangular profiles of the handrail profiles 17. By engaging into the respective bore holes of two adjacent handrail profiles 17, the latter can no longer shift in the longitudinal direction of the playing field boundary. In FIG. 4, the fastening devices 31 can also be recognized, which extend in the transverse direction to the longitudinal extension of the handrail profiles and via which the butt connectors 18 each connect two adjacent handrail profiles 18.

As FIG. 5 shows, a butt connector 18 comprises, for example, four such adjacent pins 30, of which two are each beyond the centre (viewed in the longitudinal direction) of the butt connector 18 so that each of these pins 30 are assigned to one of the two handrail profiles 17 and each engage into its bore holes, because the two handrail profiles 17 to be connected to each other are, of course, overarched by the butt connector 18 in such a way that they meet approximately at its centre. As can be furthermore seen from FIG. 5, the butt connectors 23 arranged at a distance to the inner handrail profiles 17 for the parallel outer handrail profiles 22 are principally constructed in the same way as the butt connectors 18 for the inner handrail profiles 17 and similarly comprise, in the mounted state, pins or bolts orientated approximately vertically downwards, which each engage into corresponding bore holes of the two adjacent outer handrail profiles. In addition, the outer butt connectors 23 can also be connected to the outer handrail profiles via horizontal screw connections 31.

Figure 8:
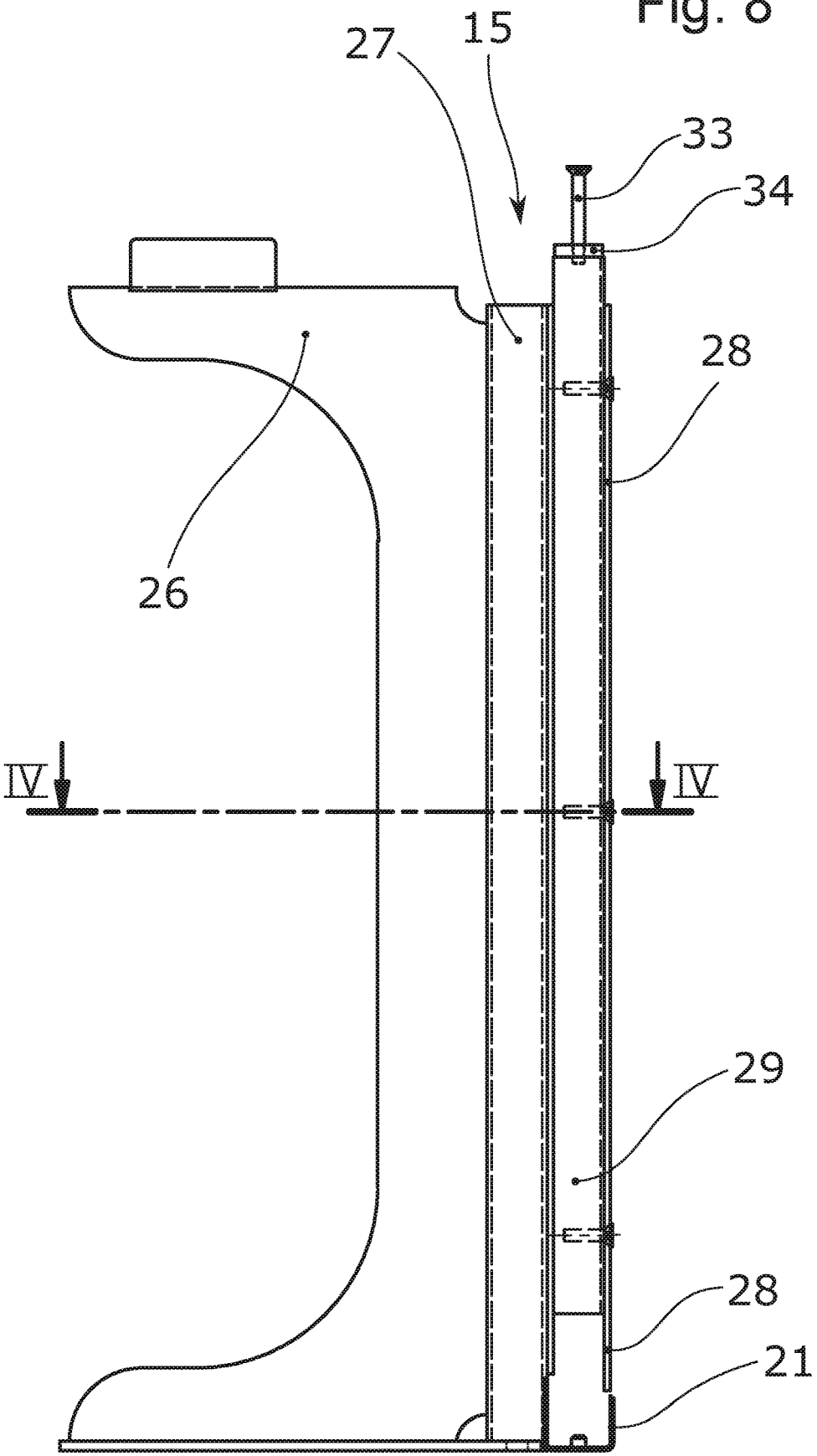
FIG. 8 a view of the support structure in the region of an intermediate post.
Figure 9:
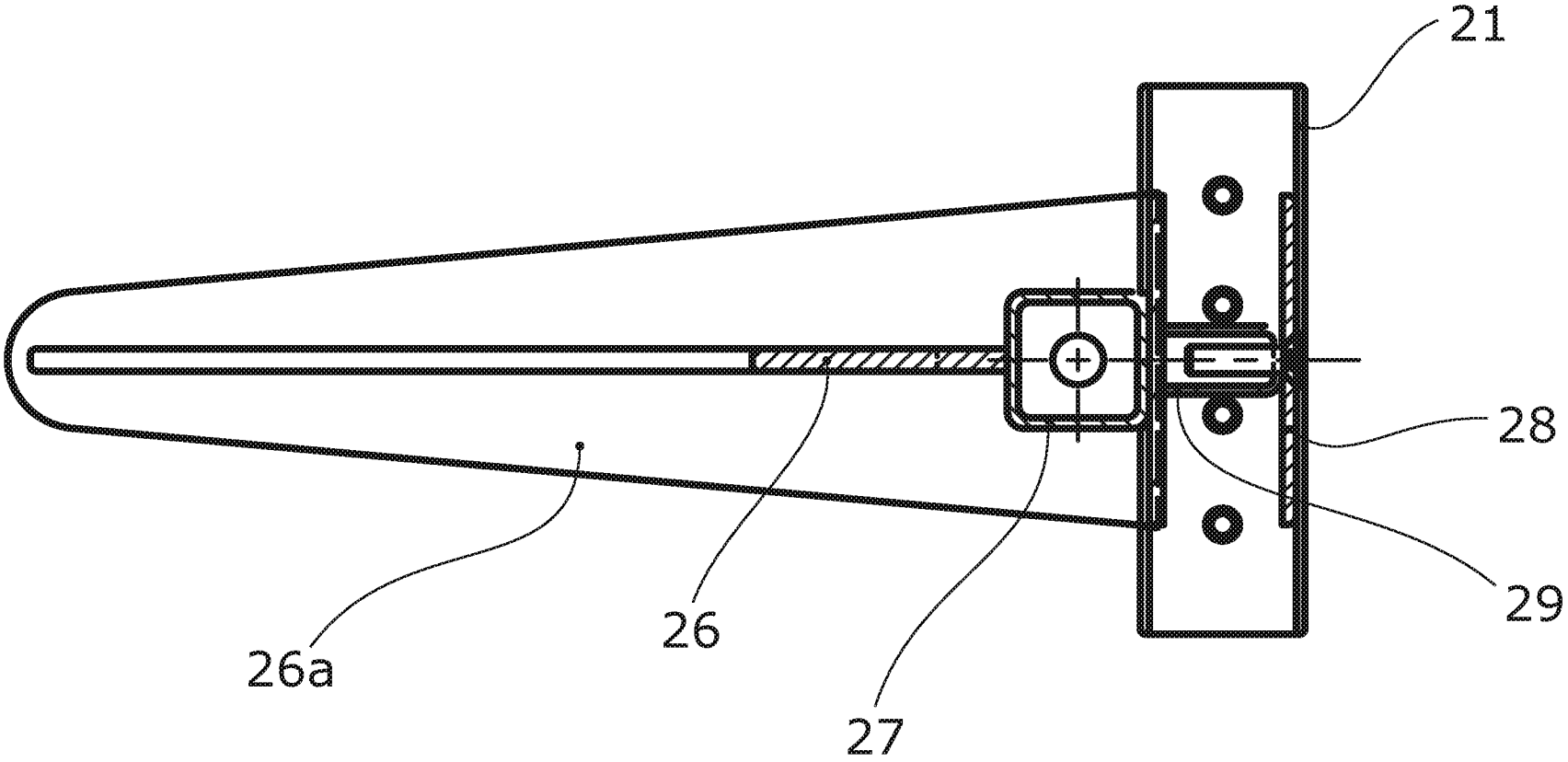
FIG. 9 a horizontal section through the intermediate post in FIG. 8.

In FIG. 8 it can furthermore be recognized that screws 33 are provided, which are vertically screwed into a bore hole of a head plate 34 of the posts and into a bore hole of the butt connector 18, wherein these screws 33 can also be recognized in FIGS. 3 and 4. These screws secure the U-shaped butt connectors 18 on the posts against falling off and being removed.

Figure 6:
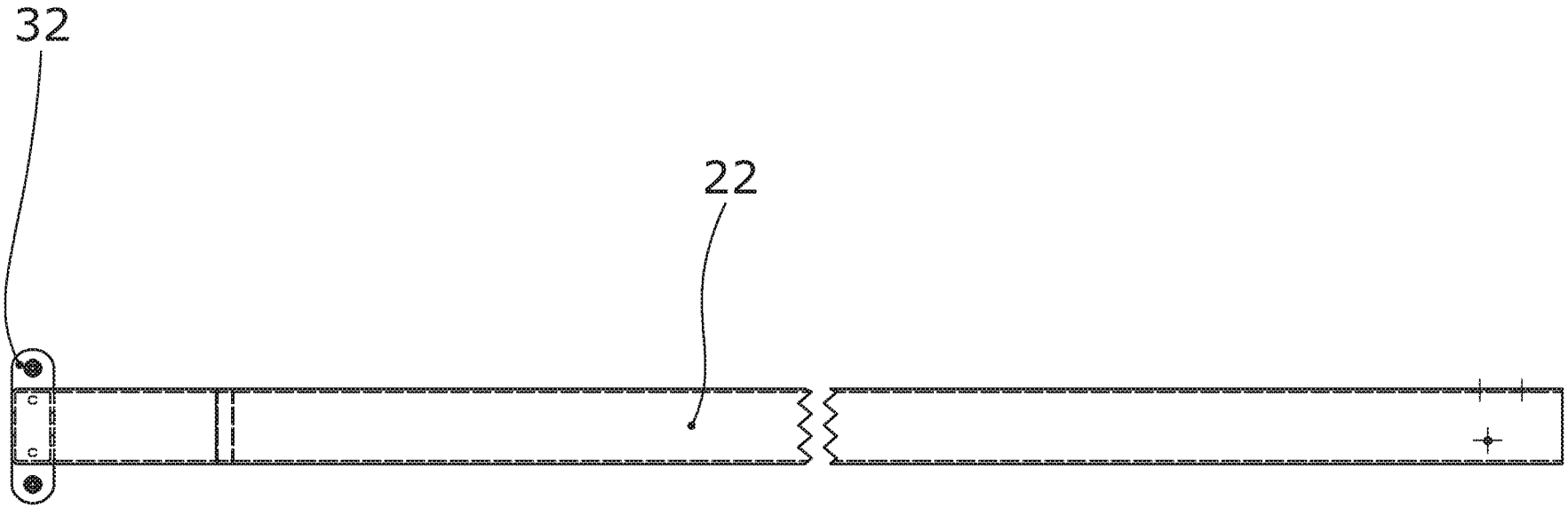
FIG. 6 a view of a section of the handrail in the region of a corner post.
Figure 7:
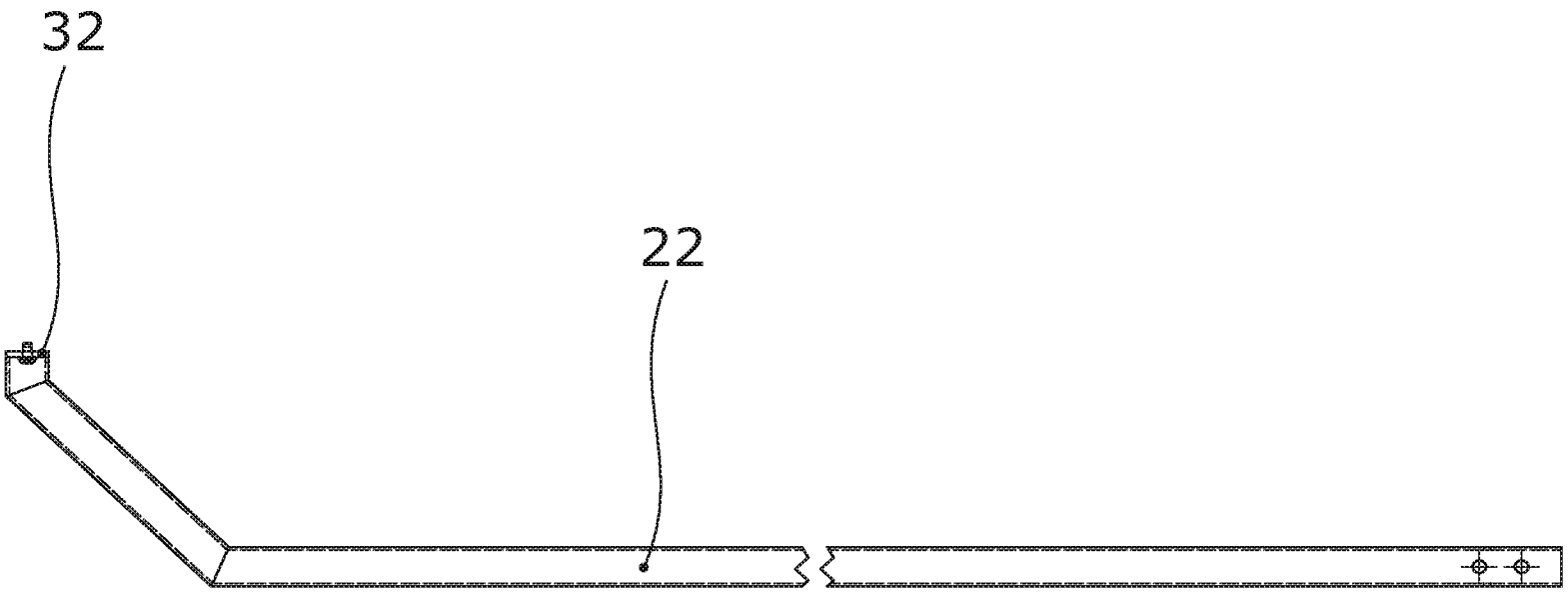
FIG. 7 a top view on the handrail in accordance with the view in FIG. 6.

In the following, reference is made to FIGS. 6 and 7, which, in each case, in the side view or in the top view, show a section of the outer handrail profiles 22, which runs, on the one hand, in the longitudinal direction of the longitudinal side 11 of the playing field boundary and which is then bluntly angled twice, thereby running towards the corner post 14 (see also FIG. 1) so that the outer handrail can be screwed on a lateral surface of the corner post 14 via a connecting plate 32 and fastening elements. Due to the doubly-blunt angling, the connecting plate 32 runs in a plane parallel to the longitudinal extension of the outer handrail profiles. In the top view on the entire playing field in accordance with FIG. 1, the angling in the corner region can also be recognized, through which the outer handrail profile 22 runs towards the corner post 14. This type of attachment of the outer handrail profile 22 via the connecting plate 32 to the corner post 14 also achieves a high level of stability in the corner region of the playing field boundary and a favourable force flow from the longitudinal side 11 to the transverse side 12 of the playing field boundary.

Figure 10:
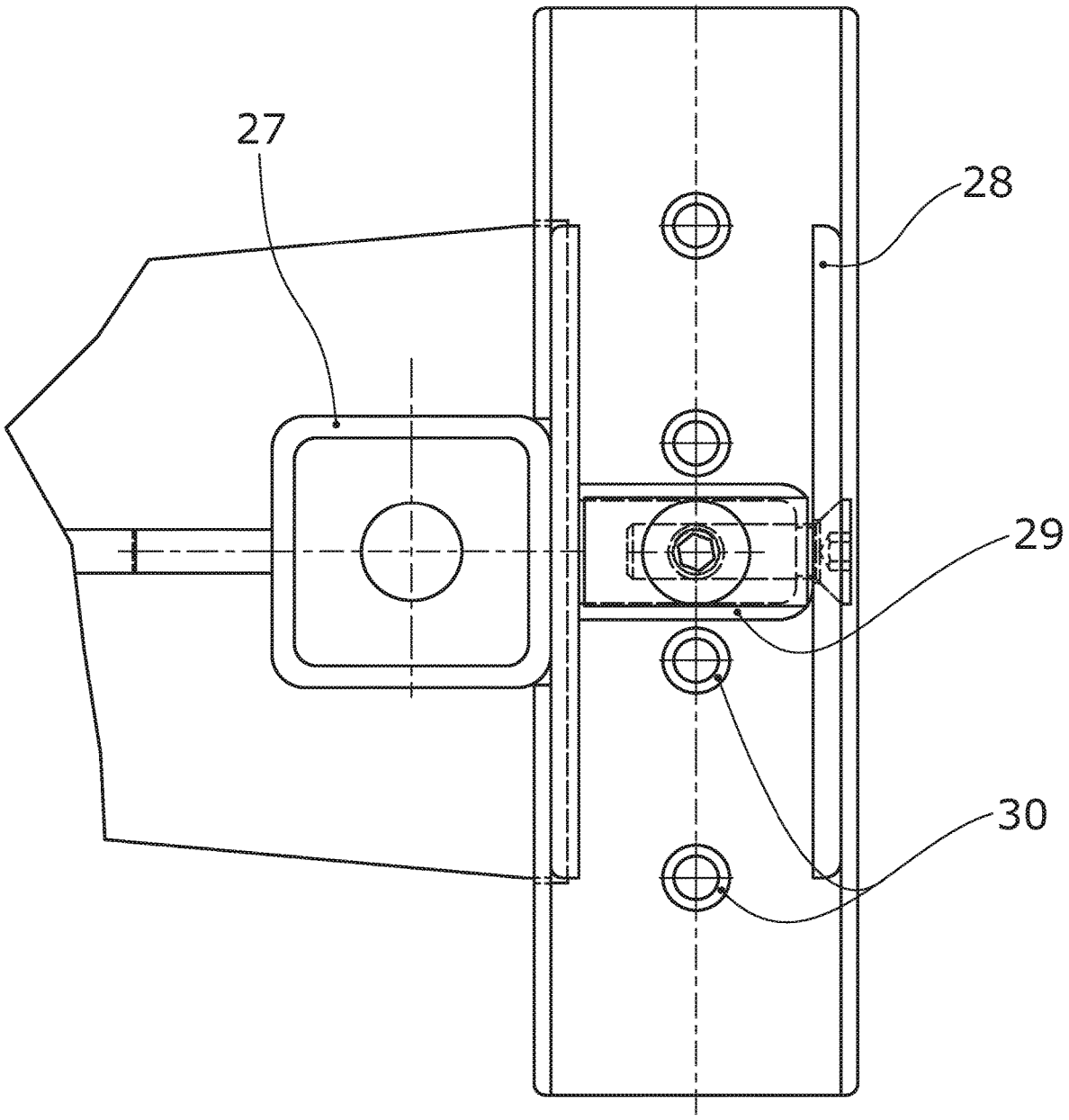
FIG. 10 a top view in the region of the intermediate post in FIG. 8.
Figure 11:
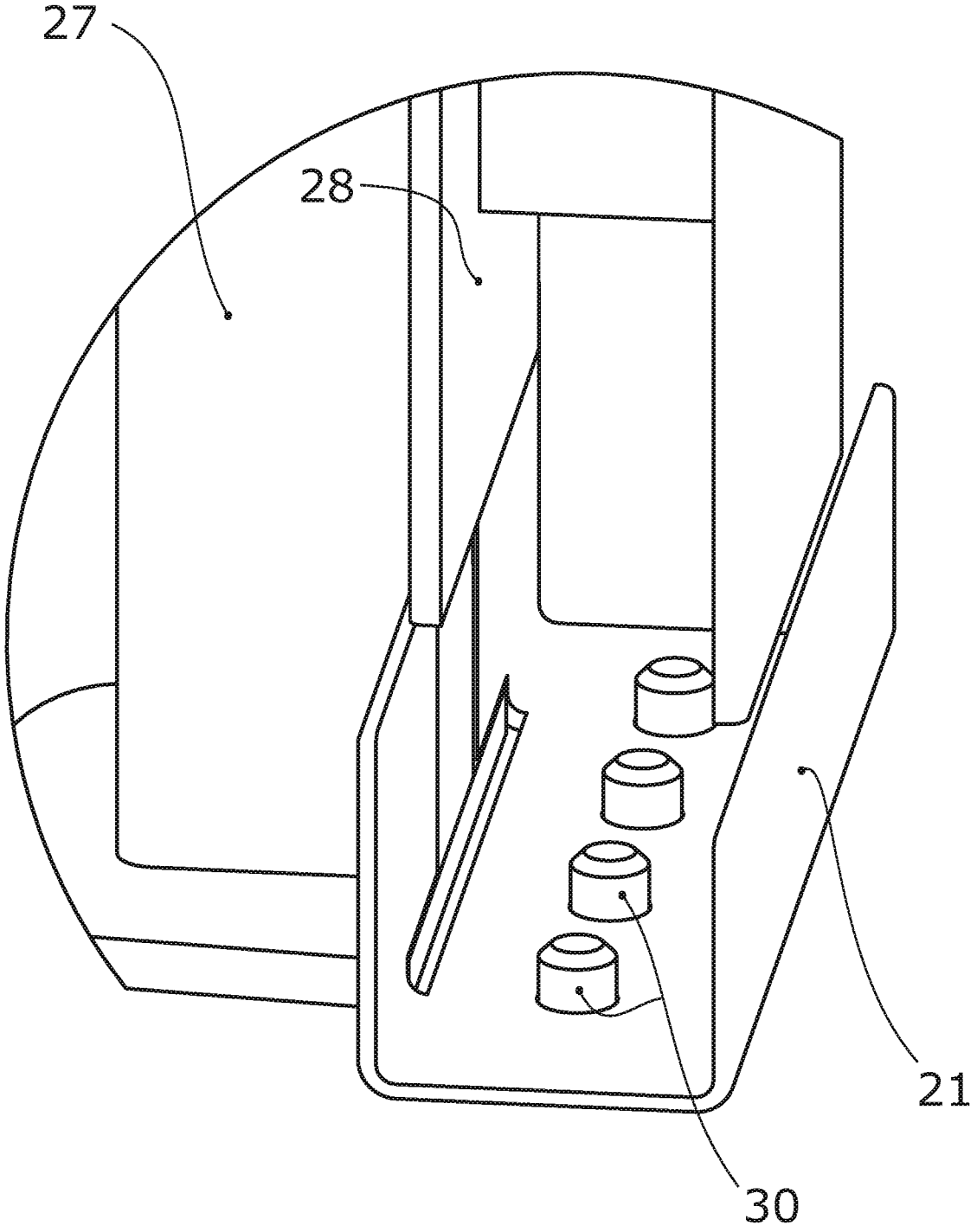
FIG. 11 a perspective partial view in the lower region of the intermediate post.

In the following, reference is made to FIGS. 10 and 11 and, based on these, the geometric conditions is clarified once again in the region of one of the intermediate posts 15, wherein one recognizes in the enlarged perspective illustration in accordance with FIG. 11 how the post is connected to the lower butt connector 21. There, one recognizes the two metal sheets 28 and the adjacent rectangular posts 27; in FIG. 10, the U-profile 29 can also be seen, which extends between the two metal sheets 28 in the transverse direction. In FIG. 11, one can see the upwardly open U-profile of the butt connector 21 for the footpath profile and one can see that, in the U-bar, there are a total of four pins 30 approximately lying in a row, which protrude upwards so that they can engage into bore holes of the two adjacent footpath profiles 20, which connect them in the region where they meet.

LIST OF REFERENCE NUMERALS

10 longitudinal side
11 longitudinal side
12 transverse side
13 transverse side
14 corner posts
15 intermediate posts, vertical posts
16 fence elements
17 inner handrail profile
18 butt connector
18 upper U-bar
19 fastening devices
20 footpath profile
21 butt connector
22 outer handrail profile
23 butt connector
24 connector
26*a* standing space
27 rectangular posts
28 metal sheets
29 U-profile
30 pins, bolts
31 fastening devices, screw connections
32 vertical plate
33 screws
34 head plate

The invention claimed is:

1. Playing field boundary for a small playing field, which is modularly constructed of fence elements (16) in the form of plates or panels and vertical posts (14, 15), to which these fence elements (16) are attached, wherein the individual panels of the fence elements are bordered at least on the top by approximately horizontally running handrail profiles (17), wherein butt connectors (18) are respectively provided, which each overarch across two adjacent handrail profiles (17) across a part of their length at the region where they meet, wherein the butt connectors (18) each connect two adjacent fence elements (16) among one another, wherein fastening devices (31) extending in the transverse direction to the handrail profiles (17) are provided in order to connect one butt connector (18) each to two adjacent handrail profiles (17) and wherein shearing/pressure elements are provided in the region of the butt connectors to respectively also connect adjacent handrail profiles to one another in their longitudinal direction in a high-tensile-strength and pressure-resistant manner, characterized in that, pins (30) or bolts integrated into the butt connectors are provided as shearing/pressure elements, which each engage into corresponding bore holes of two adjacent handrail profiles (17).

2. Playing field boundary for a small playing field according to claim 1, characterized in that the pins (30) or bolts are each welded into the butt connectors (18).

3. Playing field boundary for a small playing field according to claim 1, characterized in that the butt connectors (18) are formed as downwardly open U-profiles and the pins or bolts (30) are each attached on the inner side and, in the mounted state, attached to an upper horizontal bar (18 a) of these U-profiles protruding downwards.

4. Playing field boundary for a small playing field according to claim 1, characterized in that the handrail profiles (17) are designed as rectangular profiles and the bore holes that receive the bolts or pins (30) of the butt connectors (18) are incorporated into the upper horizontal wall of the rectangular profiles.

5. Playing field boundary for a small playing field according to claim 1, characterized in that the vertical posts (15) are extended upwardly into the butt connectors (18) and the posts each comprise a head plate (34) with at least one bore hole, wherein the butt connectors (18) comprise at least one corresponding bore hole for a fastening screw (33), which is used to connect the butt connectors to the posts in the vertical direction.

6. Playing field boundary for a small playing field according to claim 1, characterized in that, in addition to the handrail profiles (17) in the lower regions of the panels, footpath profiles (20) are provided, which extend in the longitudinal direction of the playing field boundary, wherein, in the connecting region of two adjacent fence elements (16), butt connectors (21), which are open towards the top and have a U-shaped cross-sectional profile, are provided for the footpath profiles, wherein pins (30) or bolts, which engage into corresponding bore holes of the footpath profiles (20), are also integrated into these butt connectors (21), which are used as shearing/pressure elements in the footpath region.

7. Playing field boundary for a small playing field according to claim 1, characterized in that at least some of the vertical posts are designed as intermediate posts (15), which comprise, in the region of the butt connectors (18), two vertically running metal sheets (28) orientated in the longitudinal direction of the playing field boundary and a vertically orientated U-profile (29), which is arranged between these metal sheets and connected to these metal sheets, wherein only the two sheets extend downwards in the vertical direction to the butt connectors.

8. Playing field boundary for a small playing field according to claim 7, characterized in that the intermediate posts (15) are reinforced by a vertically running additional rectangular post profile (27) arranged next to the two metal sheets (28) and the U-profile.

9. Playing field boundary for a small playing field according to claim 1, characterized in that, at distance to the inner handrail profiles (17), parallel outer handrail profiles (22) are arranged, which are also connected to one another via butt connectors in the longitudinal direction, wherein, profile-like connectors (24) running at right angle to the inner and the outer handrail profiles connect the butt connectors for the inner handrail profiles and butt connectors for the outer handrail profiles with one another, wherein the butt connectors for the outer handrail profiles can preferably be connected to the outer handrail profiles via pins (30) or bolts, which each engage into corresponding bore holes of the two adjacent handrail profiles (22), and/or via horizontal screw connections.

10. Playing field boundary for a small playing field according to claim 1, characterized in that, in corner regions between a longitudinal side (10, 11) of the playing field boundary and a transverse side (12, 13) of the playing field boundary a handrail is bluntly angled twice from the longitudinal side viewed from the top and a vertical plate (32) is attached to the handrail on the end side, which plate can be attached to a corner post via fastening means.

* * * * *